US011745941B2

(12) United States Patent
Perez et al.

(10) Patent No.: US 11,745,941 B2
(45) Date of Patent: Sep. 5, 2023

(54) CINCHES FOR WASTE RECEPTACLES AND WASTE RECEPTACLES INCLUDING CINCHES

(71) Applicant: Rubbermaid Commercial Products LLC, Atlanta, GA (US)

(72) Inventors: Juan Carlos Perez, Huntersville, NC (US); Ryan Baker, Charlotte, NC (US); Christopher Parke, Huntersville, NC (US); Wesley Alan Steen, Charlotte, NC (US)

(73) Assignee: RUBBERMAID COMMERCIAL PRODUCTS LLC, Atlanta, GA (US)

( * ) Notice: Subject to any disclaimer, the term of this patent is extended or adjusted under 35 U.S.C. 154(b) by 0 days.

(21) Appl. No.: 16/910,500

(22) Filed: Jun. 24, 2020

(65) Prior Publication Data

US 2020/0407157 A1 Dec. 31, 2020

Related U.S. Application Data

(60) Provisional application No. 62/866,328, filed on Jun. 25, 2019.

(51) Int. Cl.
*B65F 1/06* (2006.01)
*B65F 1/14* (2006.01)

(52) U.S. Cl.
CPC ..... *B65F 1/06* (2013.01); *B65F 1/1426* (2013.01); *B65F 2220/00* (2013.09)

(58) Field of Classification Search
CPC ..... B65F 1/06; B65F 1/1426; B65F 1/141; B65F 2220/00; B65D 25/16
USPC ..... 220/495.06, 495.11, 495, 908.1, 495.08, 220/676
See application file for complete search history.

(56) References Cited

U.S. PATENT DOCUMENTS

| | | | | |
|---|---|---|---|---|
| 3,817,563 | A | 6/1974 | McGlothlin | |
| 3,825,150 | A | 7/1974 | Taylor | |
| 4,027,774 | A | 6/1977 | Cote | |
| 4,923,087 | A | 5/1990 | Burrows | |
| 5,261,553 | A | 11/1993 | Mueller et al. | |
| 5,636,416 | A | 6/1997 | Anderson | |
| 5,695,088 | A | 12/1997 | Kasbohm | |
| D401,383 | S | 11/1998 | Gish | |
| 7,980,411 | B2 | 7/2011 | Kasbohm | |
| 8,807,381 | B2 | 8/2014 | Wentz et al. | |
| 9,079,711 | B2 | 7/2015 | Pho et al. | |
| 10,273,081 | B2 | 4/2019 | Cramer et al. | |
| 2007/0202751 | A1* | 8/2007 | Wentz | B23P 11/00 439/675 |

(Continued)

FOREIGN PATENT DOCUMENTS

WO 2007092486 A1 8/2007

*Primary Examiner* — John K Fristoe, Jr.
*Assistant Examiner* — Elizabeth J Volz
(74) *Attorney, Agent, or Firm* — EVERSHEDS SUTHERLAND (US) LLP

(57) ABSTRACT

A waste receptacle includes a cinch tab and a cinch defined by the cinch tab. The cinch includes an opening configured to admit a liner portion of a waste liner. The cinch also includes a notch continuous with and extending away from the opening. At least a portion of the opening narrows in width in a direction extending away from the notch. The opening and the notch are configured to retain the liner portion to at least partially secure the waste liner to the waste receptacle.

20 Claims, 6 Drawing Sheets

(56) References Cited

U.S. PATENT DOCUMENTS

| | | | | |
|---|---|---|---|---|
| 2008/0197136 | A1 | 8/2008 | Dukes | |
| 2008/0257889 | A1* | 10/2008 | Kovacevich | B65F 1/08 220/495.11 |
| 2008/0272127 | A1 | 11/2008 | Kovacevich et al. | |
| 2012/0037636 | A1* | 2/2012 | Ratzlaff | B65F 1/1468 220/661 |
| 2017/0341858 | A1* | 11/2017 | Cramer | B65F 1/1426 |

* cited by examiner

CINCHES FOR WASTE RECEPTACLES AND WASTE RECEPTACLES INCLUDING CINCHES

CROSS-REFERENCE TO RELATED APPLICATIONS

This application claims priority benefit to U.S. Provisional Patent Application No. 62/866,328, filed Jun. 25, 2019, which is incorporated by reference herein.

BACKGROUND

1. Technical Field

The present disclosure relates generally to cinches, and in particular, cinches for waste receptacles, for example, cinches for securing waste receptacle liners to waste receptacles.

2. Description of the Related Art

Waste receptacles may be used for holding and disposal of a variety of material such as trash, recyclables, yard waste, industrial waste, commercial waste, or medical waste. Waste liners are often used with waste receptacles to promote hygiene and sanitation. Liners may simplify maintenance of waste receptacles. For example, instead of having to replace, empty, wash, or clean the waste receptacle itself, the liner can be removed and discarded with the waste, and replaced with a fresh liner.

The liner may in advertently detach from the receptacle. For example, contact with waste, an object, or a surface, or weight of waste may cause the liner to detach from the receptacle. Such detachment of the liner may cause waste to contact a surface of the receptacle.

SUMMARY

The present disclosure describes cinches for waste receptacles and waste receptacles having such cinches. Cinches according to the present disclosure may be used to secure and retain liners and avoid or reduce incidences of premature or inadvertent detachment.

In embodiments, a waste receptacle includes a cinch tab and a cinch defined by the cinch tab according to the present disclosure. The cinch includes an opening configured to admit a liner portion of a waste liner. The cinch also includes a notch continuous with and extending away from the opening. At least a portion of the opening narrows in width in a direction extending away from the notch. The opening and the notch are configured to retain the liner portion to at least partially secure the waste liner to the waste receptacle. For example, an upper portion of the waste liner may be secured about a rim of the waste receptacle, and a liner portion of the waste liner may extend through and be retained by the cinch to hold the waste liner in place.

Figure 1A:
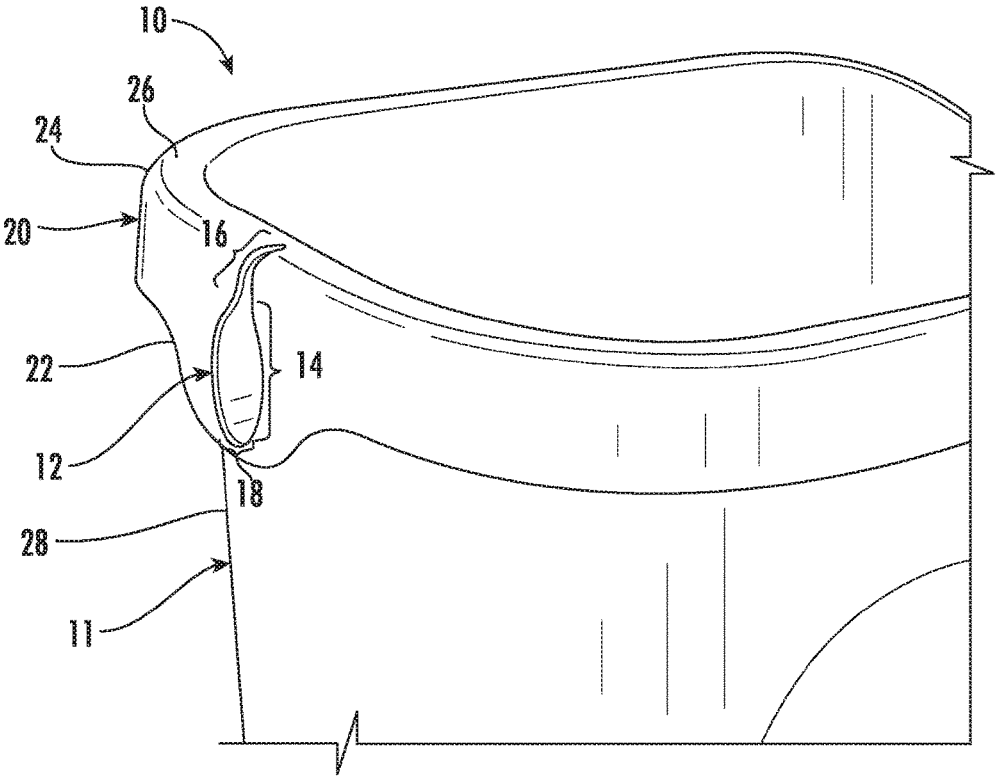
FIG. 1A is a conceptual perspective partial view of a waste receptacle including a cinch.

It is to be understood that the invention is not limited in its application to the details of construction and the arrangement of components illustrated in the drawings or set forth in the following description.

DETAILED DESCRIPTION

The present disclosure describes cinches for waste receptacles and waste receptacles having such cinches. Cinches according to the present disclosure may be used to secure and retain liners and avoid or reduce incidences of premature or inadvertent detachment.

In embodiments, a waste receptacle includes a cinch tab and a cinch defined by the cinch tab according to the present disclosure. The cinch includes an opening configured to admit a liner portion of a waste liner. The cinch also includes a notch continuous with and extending away from the opening. At least a portion of the opening narrows in width in a direction extending away from the notch. The opening and the notch are configured to retain the liner portion to at least partially secure the waste liner to the waste receptacle. For example, an upper portion of the waste liner may be secured about a rim of the waste receptacle, and a liner portion of the waste liner may extend through and be retained by the cinch to hold the waste liner in place.

The phrase "cinch tab" may refer to a region integral with a housing of the waste receptacle, or to a component of the waste receptacle, or to a separate component that may be attachable, either permanently attachable or removably attachable, to the waste receptacle.

In some embodiments, the notch of the cinch narrows in a direction extending away from the opening. In some embodiments, the cinch has a teardrop-shaped periphery. In some embodiments, the narrowing of the notch or the teardrop shape of the cinch may facilitate introducing (for example, pulling) a liner portion through an opening of the cinch and securing (for example, holding) the liner portion in the notch.

The notch and opening of cinches according to the present disclosure may secure and retain waste liners to reduce or avoid inadvertent detachment of waste liners from waste receptacles. Cinches according to the present disclosure may also allow relatively easy removal of liners from receptacles for replacement. The cinches may also facilitate securing multiple liners (for example, nested liners) to waste receptacles.

Figure 1B:
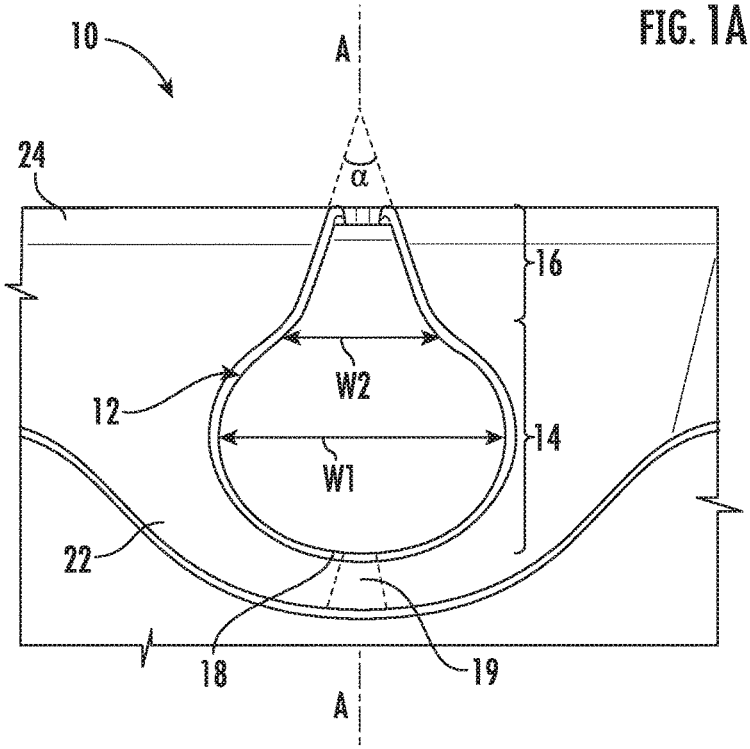
FIG. 1B is a front partial view of the waste receptacle of FIG. 1A.
Figure 1C:
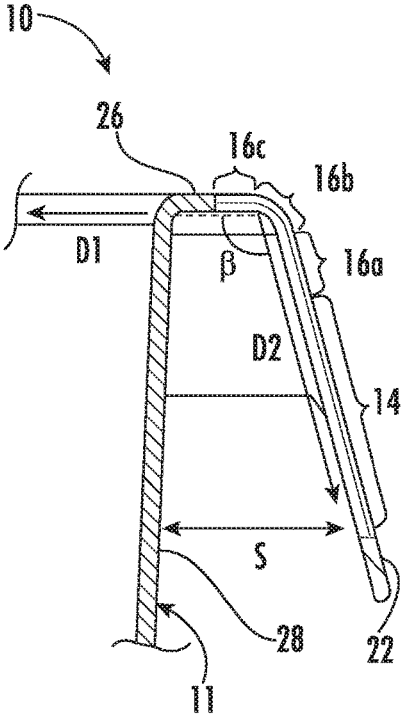
FIG. 1C is a cross-sectional view of the waste receptacle of FIG. 1B at line A-A.

FIG. 1A is a conceptual perspective partial view of a waste receptacle 10 including a cinch 12. FIG. 1B is a front partial view of waste receptacle 10 of FIG. 1A. FIG. 1C is a cross-sectional view of waste receptacle 10 of FIG. 1B at line A-A.

Waste receptacle 10 includes a housing 11 configured to receive and retain the waste liner. Housing 11 may have any general shape, for example, cuboidal, rectangular cuboidal, cylindrical, or any other suitable shape. Housing 11 may include faces or walls that may be smoothly interconnected, or may intersect at vertexes or edges. In some embodiments, housing 11 may have substantially the same cross-sectional area along a height of the housing. In other embodiments, the cross-sectional area may vary, for example, continuously increase along a height, or decrease, or any other variation. Housing 11 may define at least one opening, for example, an upper opening, to receive the waste liner. Housing 11 may be formed of one or more materials, or a composite material. In some embodiments, one or more materials forming housing 11 may include one or more of a metal, an alloy, a polymer, a glass, a fabric, a composite, or combinations thereof. In some embodiments, housing 11 is substantially rigid, for example, tending to maintain its shape and resist deformation.

Cinch 12 may facilitate retaining the waste liner on waste receptacle 10, for example, in housing 11 of waste receptacle 10. Cinch 12 includes an opening 14 configured to admit a liner portion of a waste liner (not shown in FIGS. 1A to 1C). Cinch 12 includes a notch 16 continuous with and extending away from opening 14. At least a portion of opening 14 narrows in width in a direction extending away from notch 16. For example, a lower portion of opening 14 may narrow in width in a direction extending away from notch 16. In some embodiments, the direction away from notch 16 may be substantially aligned with a direction of gravity. Without wishing to be bound by theory, the narrowing of at least a portion of opening 14 in a direction away from notch 16 may promote retention of the waste liner in cinch 12, for example, by avoiding inadvertent detachment or removal of the liner portion from cinch 12. In some embodiments, opening 14 may define a U-shaped or V-shaped periphery that narrows in width in a direction away from notch 16. In some embodiments, opening 14 may continuously narrow in width from one end of opening 14 adjacent notch 16 to another end of opening 14 opposing notch 16. In some embodiments, a first portion of opening 14 may widen in width in a direction extending away from notch 16, and a second portion of opening 14 may narrow in width in a direction extending away from notch 16. In some embodiments, opening 14 of cinch 12 is substantially circular, oval, oblate, or ellipsoidal. In some embodiments, opening 14 is circular. In some embodiments, opening 14 has a U-shaped periphery, for example, a smooth U-shaped periphery, or angled or vertexed U-shaped periphery. In other embodiments, opening 14 has a polygonal or complex (combination of curved and linear) periphery. For example, opening 14 may have a triangular, square, pentagonal, hexagonal, or n-sided regular or irregular polygonal periphery, where n is a whole number greater than 2. In some embodiments, opening 14 of cinch 12 defines a zig-zag or undulating periphery. For example, the periphery may be star-shaped, with m exterior vertices, where m is a whole number greater than 2. In some such embodiments, the zig-zag, undulating, or star-shaped periphery may promote locking or securing of the liner portion in cinch 12 or the waste liner to waste receptacle 10.

Opening 14 and notch 16 are configured to retain the liner portion to at least partially secure the waste liner to waste receptacle 10. In some embodiments, one or both of opening 14 or notch 16 may be substantially symmetrical about respective symmetry axes. For example, cinch 12 may be substantially symmetric, as a whole, about a symmetry axis. In other embodiments, one or both of opening 14 or notch 16 may be substantially asymmetrical or skewed. For example, cinch 12, as a whole, may be substantially asymmetric or skewed.

Notch 16 of cinch 12 may generally narrow in a direction extending away from opening 14. For example, notch 16 may be generally triangular, or curved triangular. In some embodiments, notch 14 of cinch 12 defines a zig-zag or undulating periphery. In some such embodiments, the zig-zag or undulating periphery may promote locking or securing of the liner portion in cinch 12 or the waste liner to waste receptacle 10.

In some embodiments, opening 14 an notch 16 define a generally teardrop-shaped periphery of cinch 12. For example, the periphery may generally follow a teardrop shape, with or without local perturbations or deviations from the teardrop shape. In some embodiments, the teardrop shape may include an undulating or zig-zag portion or peripheral segment.

Opening 14 and notch 16 may together define a closed periphery of cinch 12. For example, a lower edge 18 of cinch 12 may be closed. In some embodiments, lower edge 18 of cinch 12 may be open, for example, continuous with an opening 19. In some embodiments, cinch tab 22 extends continuously about cinch 12. In other embodiments, cinch tab 22 defines a discontinuity. The discontinuity may oppose notch 14 and extend away from opening 14 of cinch 12. For example, the discontinuity may be or include opening 19 adjacent lower edge 18 of cinch 12.

In some embodiments, notch 16 includes opposing edges defining an interior angle $\alpha$, for example, as shown in FIG. 1B. The opposing edges may be straight, linear, piecewise linear, curved, or include a complex periphery including combinations thereof. The interior angle $\alpha$ is less than a predetermined threshold angle. For example, the predetermined threshold angle is sufficiently low to cause the liner portion pushed or pulled through opening 14 to lock against opposing edges of notch 16 otherwise be retained or held in notch 16 to hold or secure the waste liner in waste receptacle 10. In some embodiments, the predetermined threshold angle is 45° or less, or 40° or less, or 35° or less, or 30° or less, or 25° or less, or 15° or less, or 10° or less. In some embodiments, the interior angle $\alpha$ is 25°. In some embodiments, notch 16 may include opposing edges that include more than one linear or curved sections that progressively reduce in separation or angle, tending to interior angle $\alpha$.

A maximum width of opening 14 is generally greater than a maximum width of notch 16. For example, opposing edges of opening 14 or a periphery of opening 14 may define a maximum width W1, while opposing edges of notch 14 may define a maximum width W2, as shown in FIG. 1B, with W1>W2. In other embodiments, W1=W2. In some embodiments, W1 may be in a range of from about 0.5 inches to about 2.0 inches. In some embodiments, W2 may be in a range of from about 0.1 inches to about 0.5 inches. In some embodiments, W1 and W2 may be in a ratio W1:W2 of from about 5 to about 1. In some embodiments, W1 is 1.13 inches and W is 0.22 inches.

Waste receptacle 10 may include a lip 20. In some embodiments, lip 20 includes a cinch tab 22. In other embodiments, waste receptacle 10 may not include lip 20, and a different portion or component of waste receptacle 10 may include or define cinch tab 22. In some embodiments, cinch tab 22 defines cinch 12. For example, a material of cinch tab 22 may define opening 14 and notch 16 of cinch 12.

In some embodiments, cinch tab 22 defines a substantially flat surface contour. For example, cinch tab 22 may be planar or substantially planar. In other embodiments, cinch tab 22 defines a curved surface contour. In some embodiments, cinch tab 22 defines a complex surface including at least one substantially flat surface portion and at least one curved surface portion.

Lip 20 may be connected by a curved transition 24 to an upper rim 26 of waste receptacle 10. Thus, in some embodiments, lip 20 may be continuous with upper rim 26 through curved transition 24. In other embodiments, waste receptacle 10 may not include curved transition 26, and lip 20 may be directly connected to upper rim 26 or another portion or surface of waste receptacle 10.

Thus, in some embodiments, waste receptacle 10 includes upper rim 26 adjacent to and continuous with cinch tab 22. In some embodiments, upper rim 26 is substantially horizontal relative to a direction of gravity, for example, 90°, or in a range of 90°±1, or in a range of 90°±5, or in a range of 90°±10, or in a range of 90°±15.

In some embodiments, cinch tab 22 is angled at an interior angle β relative to upper rim 26. For example, upper rim 26 may extend along a direction D1, and cinch tab 22 may extend along a direction D2, with interior angle β defined at an interior intersection of directions D1 and D2, as shown in FIG. 1C. The interior angle β is greater than a predetermined threshold angle. In some embodiments, the interior angle β is sufficient to admit the liner portion, for example, alone or in combination with a tool, digit, finger, hand, or portions or combinations thereof pushing or pulling the liner portion through opening 14 and notch 16 of cinch 12. For example, the predetermined threshold angle may be at least 75°, or at least 80°, or at least 87°, or at least 89°, or at least 90°, or at least 95°, or at least 100°, or at least 110°, or at least 120°. In some embodiments, the predetermined threshold angle is 90°. In some embodiments, the interior angle β is 102°.

In some embodiments, cinch tab 22 is angled relative to upper rim 26, and notch 16 extends from cinch tab 22 to upper rim 26. For example, as shown in FIG. 1C, notch 16 may include a lower portion 16*a*, an intermediate portion 16*b*, and an upper portion 16*c*, with lower portion 16*a* defined by cinch tab 22, intermediate portion 16*b* defined by curved transition 24, and upper portion 16*c* defined by upper rim 26. The extension of upper portion 16*c* to upper rim 26 may facilitate locking or retaining of the liner portion in cinch 12. In other embodiments, notch 16 may only include lower portion 16*a*, as described with reference to FIG. 3, or only include lower portion 16*a* and intermediate portion 16*b*.

Waste receptacle 10 includes receptacle wall 28. For example, receptacle wall 28 may be generally vertical relative to a direction of gravity or inclined relative to gravity. Receptacle wall 28 may define a chamber for housing the waste liner. In some embodiments, receptacle wall 28 defines upper rim 26 of waste receptacle 10. For example, lip 20 may be continuous with receptacle wall 28 through or along upper rim 26.

In some embodiments, cinch tab 22 is spaced from receptacle wall 28 by a spacing S adjacent a lower edge of opening 14 (for example, lower edge 18). The spacing S is greater than a predetermined threshold spacing. In some embodiments, the threshold spacing is sufficient to admit the liner portion, for example, alone or in combination with a tool, digit, finger, hand, or portions or combinations thereof pushing or pulling the liner portion through opening 14 and notch 16 of cinch 12. For example, the threshold spacing may be at least 0.5 inches, 0.6 inches, 0.75 inches, 1 inch, 1.25 inches, 1.5 inches, 2 inches, or 3 inches, or more. In some embodiments, the spacing S is about 0.78 inches.

While cinch tab 22 may be formed integral with housing 11 or otherwise with receptacle 10 as described with reference to FIGS. 1A to 1C, in some embodiments, cinch tab 22 may be a separate component attachable to a waste receptacle, as described with reference to FIGS. 2A and 2B.

Figure 2A:
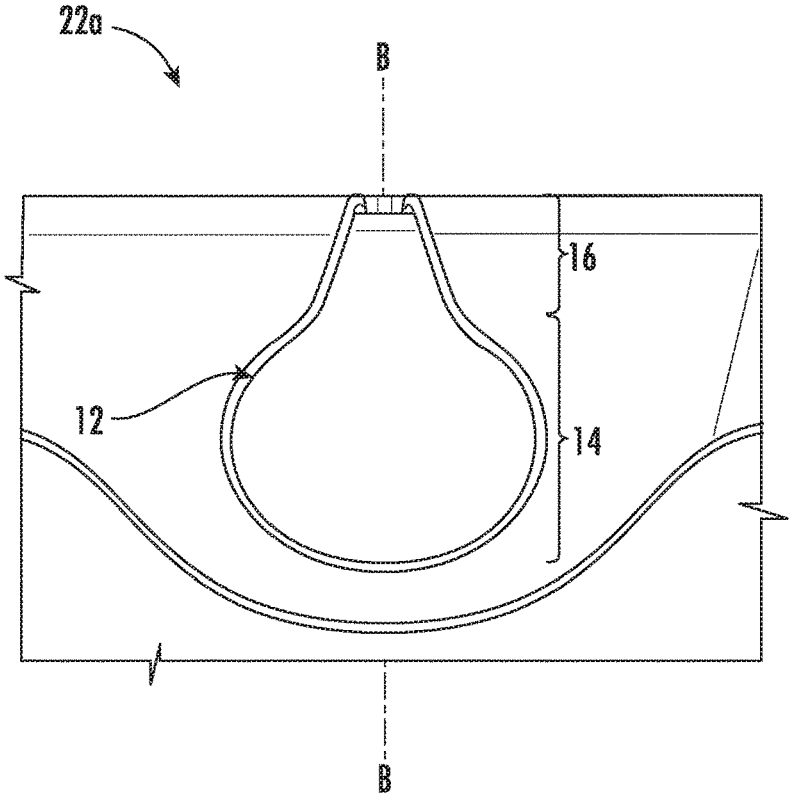
FIG. 2A is a conceptual front view of a cinch tab defining a cinch attachable to a waste receptacle.
Figure 2B:
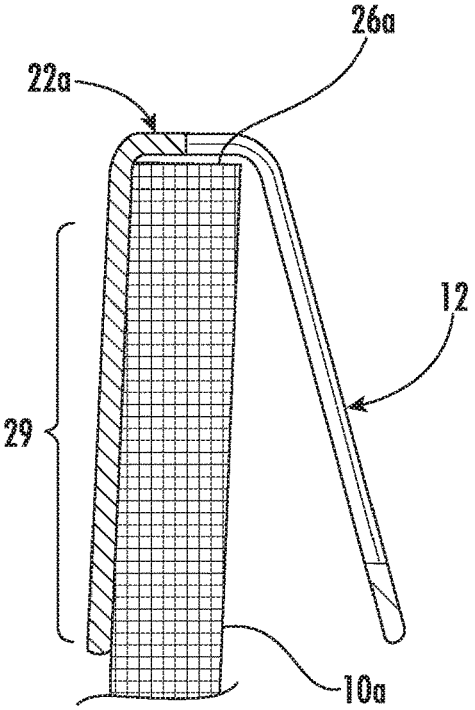
FIG. 2B is a cross-sectional view of the cinch tab of FIG. 2A at line B-B.

FIG. 2A is a conceptual front view of a cinch tab 22*a* defining cinch 12 attachable to a waste receptacle 10*a*. FIG. 2B is a cross-sectional view of cinch tab 22*a* of FIG. 2A at line B-B. Cinch tab 22*a* may be substantially similar in material, construction, dimensions, or configuration as described with reference to cinch tab 22 of FIGS. 1A to 1C, and include a cinch, for example, cinch 12. The material of cinch tab 22*a* may be the same as, or different from, the material of waste receptacle 10*a* or a component of waste receptacle 10*a*. In some embodiments, cinch tab 22*a* and waste receptacle 10*a* are both formed from the same polymeric material.

While cinch tab 22 is integral with waste receptacle 10, cinch tab 22*a* is a separate component that is attachable to waste receptacle 10*a*. Waste receptacle 10*a* may be substantially similar to waste receptacle 10 described with reference to FIGS. 1A to 1C. While waste receptacle 10*a* shown in FIGS. 2A and 2B does not include lip 20 or curved transition 24, in some embodiments, waste receptacle 10*a* may include one or more of lip 20 or curved transition 24.

Cinch tab 22*a* is attachable, for example, permanently or removably attachable, to waste receptacle 10*a*, for example, at an upper rim 26*a* of waste receptacle 10*a*. In some embodiments, cinch tab 22*a* may be placed on upper rim 26*a*, with gravity tending to hold cinch tab 22*a* in place. In some embodiments, a portion of cinch tab 22*a* may be curved to cause a mechanical securement, for example, being clippable, across upper rim 26*a*. In some embodiments, cinch tab 22*a* may include one or more clips, integrally or continuously formed or molded with cinch tab 22*a*, or joined or attached to cinch tab 22, for securing cinch tab 22*a* to upper rim 26*a*. In some embodiments, cinch tab 22*a* may be joined, for example, with a permanent, repositionable, or releasable adhesive or gel, to upper rim 26*a* or another portion of waste receptacle 10*a*. In some embodiments, more than one cinch tab 22*a* may be attached or secured to receptacle 10*a*.

In embodiments in which receptacle 10*a* includes lip 20 or curved transition 24, cinch tab 22*a* may be dimensioned to be placed, fit, secured, or retained across one or both of lip 20 or curved transition 24.

In some embodiments, cinch tab 22*a* includes a back plate 29. Back plate 29 may face and oppose cinch 12. In some embodiments, back plate 29 may be angled relative to cinch 12 to cause cinch 12 to be retained at a predetermined angle relative to waste receptacle 10*a*, relative to a direction of gravity, or relative to a horizontal plane (for example, angles α and/or β). In some embodiments, adhesive, clips, magnets, groove and tongue, slider, or other fasteners may be provided at one or more of back plate 29, an opposing front face of cinch tab 22*a*, or an upper rim or portion of cinch tab 22*a* for securing or attaching cinch tab 22*a* to waste receptacle 10*a*.

While cinch 12 of cinch tab 22 or 22*a* may extend to or along curved transition 24 or upper rim 26, in some embodiments, a cinch may not extend to upper rim 26 or along upper rim 26, as described with reference to FIG. 3.

Figure 3:
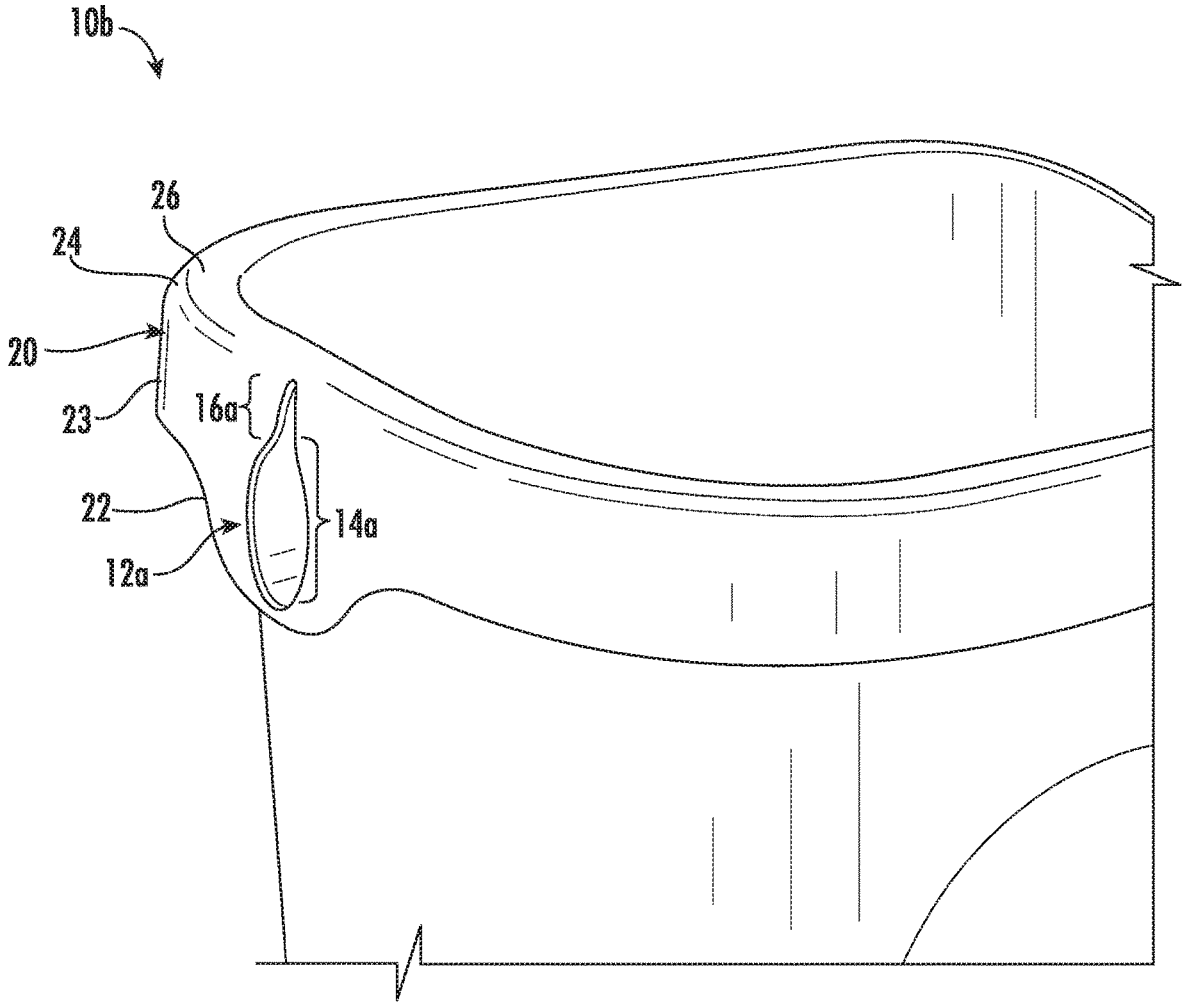
FIG. 3 is a conceptual perspective partial view of a waste receptacle including a cinch that does not extend to an upper rim.

FIG. 3 is a conceptual perspective partial view of a waste receptacle 10*b* including a cinch 12*a* that does not extend to upper rim 26. Waste receptacle 10*b* is substantially similar to waste receptacle 10 described with reference to FIGS. 1A to 1C, with cinch 12*a* being different from cinch 12 in that cinch 12*a* does not extend to upper rim 26. For example, as shown in FIG. 3, cinch 12*a* only includes lower portion 16*a* of notch 16, and does not include intermediate portion 16*b* or upper portion 16*c*. In some embodiments, cinch 12*a* includes intermediate portion 16*b* extending to curved intersection 24, but does not include upper portion 16*c*. In some embodiments, waste receptacle 12*a* does not include one or both of curved interface 24 or upper rim 26.

Some embodiments of cinches and waste receptacles including cinches according to the present disclosure have been described with reference to FIGS. 1A to 1C, 2, and 3. Some embodiments of waste receptacles including cinches are described with reference to FIGS. 4A to 4D.

Figure 4A:
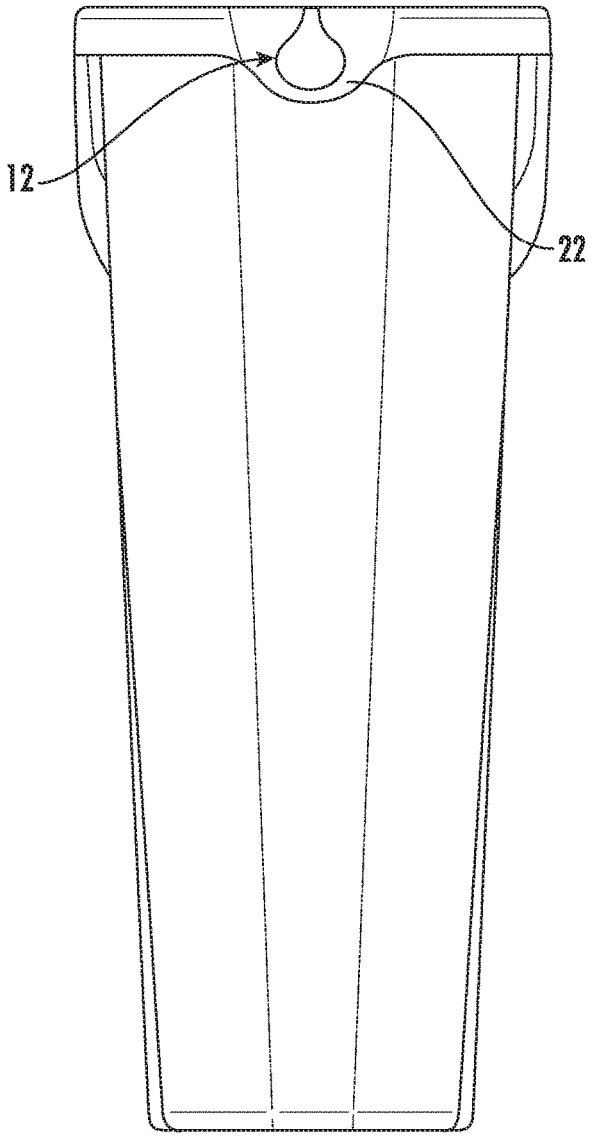
FIG. 4A is a front view of a waste receptacle including a cinch.
Figure 4B:
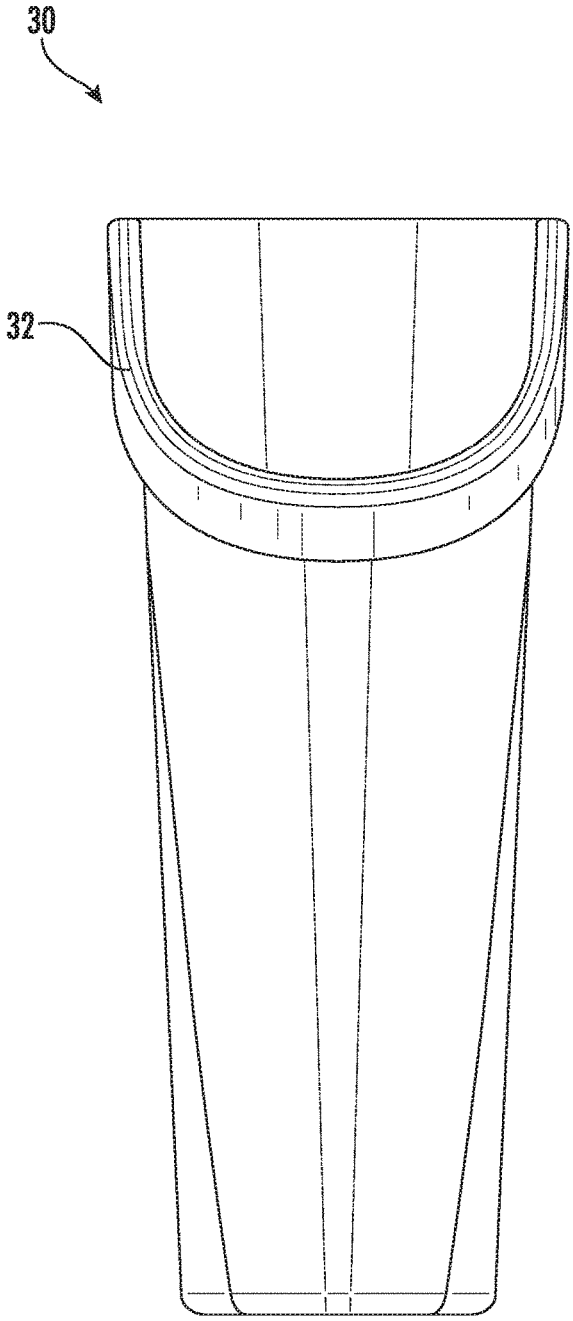
FIG. 4B is a rear view of the waste receptacle of FIG. 4A.
Figure 4D:
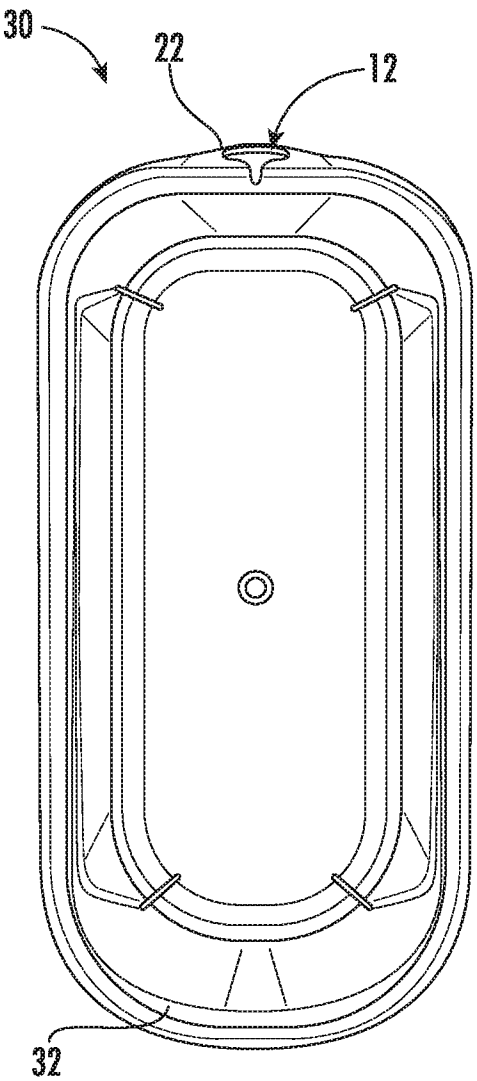
FIG. 4D is a top view of the waste receptacle of FIG. 4A.
Figure 4C:
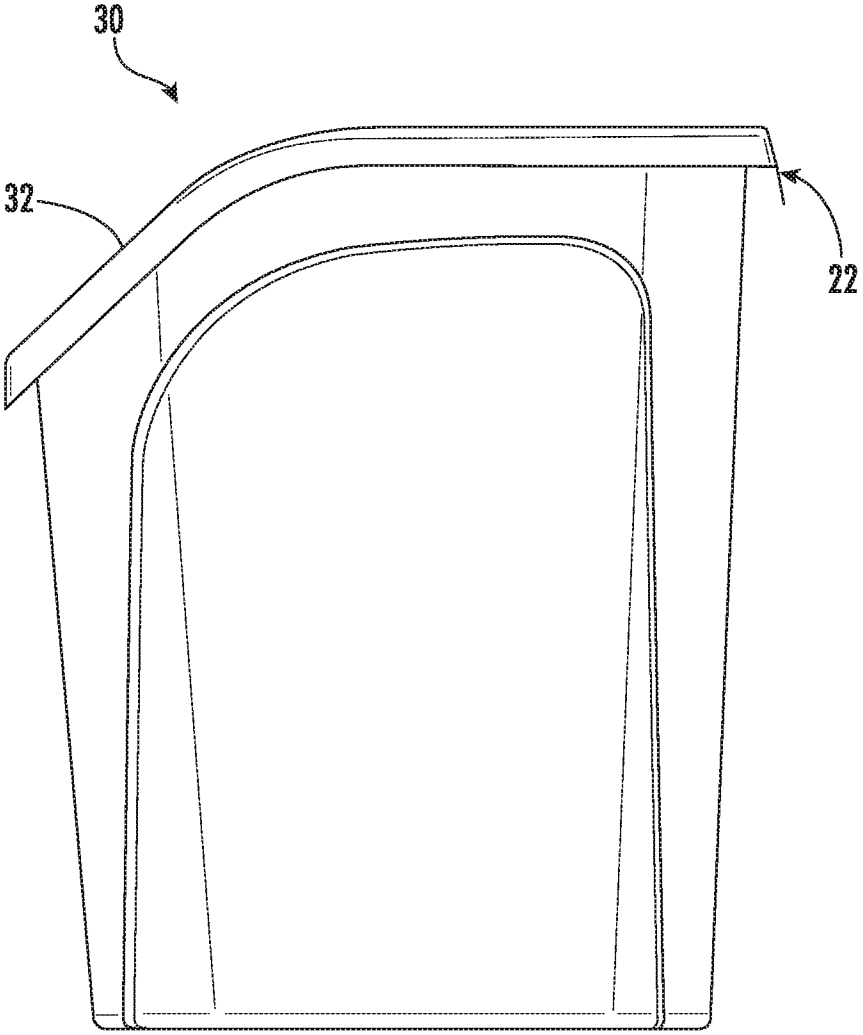
FIG. 4C is a side view of the waste receptacle of FIG. 4A.

FIG. 4A is a front view of a waste receptacle 30 including a cinch 12. FIG. 4B is a rear view of waste receptacle 30 of FIG. 4A. FIG. 4C is a side view of waste receptacle 30 of FIG. 4A. FIG. 4D is a top view of waste receptacle 30 of FIG. 4A. Waste receptacle 30 may be generally similar in construction and configuration to waste receptacle 10 of FIGS. 1A to 1C or waste receptacle 10*b* of FIG. 3. Waste receptacle 30 may include one or more instances of cinch 12 or cinch 12*a*. For example, waste receptacle 30 may include two or more cinches, that may be the same or different in location, shape, or size. In some embodiments, waste receptacle includes cinch tab 22 defining at least one cinch 12 or 12*a*. In some embodiments, cinch tab 22 defines more than one cinch, for example, at least two cinches. In some such embodiments, a first liner may be secured to a first cinch, and a second liner may be secured to a second cinch. In some embodiments, waste receptacle 30 includes more than one cinch tab. In some such embodiments, each cinch tab defines a respective single cinch. In other embodiments, at least one cinch tab defines more than one cinch.

In some embodiments, waste receptacle 30 defines an angled edge 32. Angled edge 32 may be positioned at a face opposing a face including cinch tab 22. The angled edge 32 may facilitate disposing waste in the waste receptacle at an angle relative to an upper face or upper rim 26 of waste receptacle 30, for example, if waste receptacle 30 is positioned under a counter or at a hindered or inaccessible location relative to a user of waste receptacle 30. Angled edge 32 may be angled at any suitable angle relative to horizontal plane relative to a direction of gravity. For example, angled edge 32 may be angled at at least 30°, or at least 40°, or at least 45°, or at least 50°, or at least 60° relative to the horizontal plane.

Methods of securing waste liners to waste receptacles using cinches according to the present disclosure are described with reference to FIGS. 5A to 5C. While FIGS. 5A to 5C are described with reference to waste receptacle 10 and cinch 12, it is to be understood that the method can be practiced using any waste receptacle, cinch tab, or cinch according to the present disclosure.

Figure 5A:
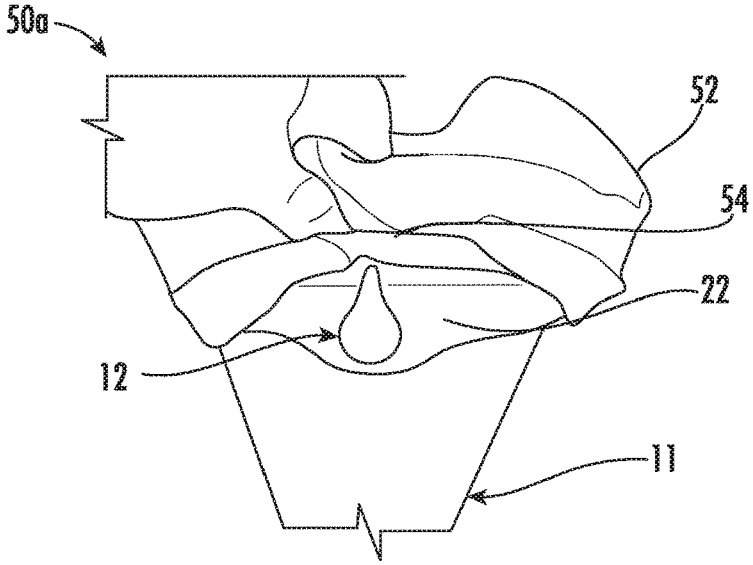
FIG. 5A is a partial perspective view of an initial configuration of an assembly including a waste liner and a waste receptacle including a cinch.

FIG. 5A is a partial perspective view of an initial configuration of an assembly 50*a* including a waste liner 52 and waste receptacle 10 including cinch 12. Waste liner 52 may be formed of one or more materials including a polymer, or any other suitable liner material. In some embodiments, waste liner 52 may include a reinforced material. In the initial configuration of assembly 50*a*, waste liner 52 is placed in housing 11 of waste receptacle 10, with an upper portion of waste liner 52 partially disposed about lip 20 of waste receptacle 10. A liner portion 54 of waste liner 52 is ready to be pushed, pulled, or a combination thereof, through cinch 12. Liner portion 54 may be any suitable portion of waste liner 52 capable of being pushed, pulled, gathered, bunched, compacted, or otherwise introduced through and secured to cinch 12.

Figure 5B:
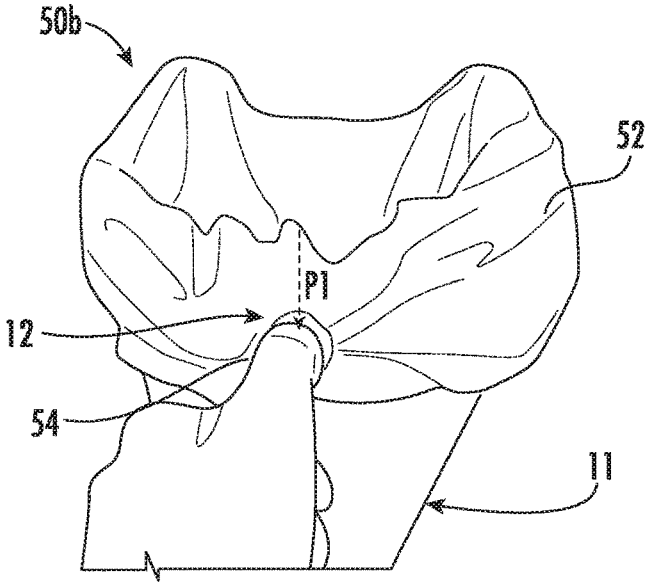
FIG. 5B is a partial perspective view of an intermediate configuration of the assembly of FIG. 5A with a liner portion partially extending through the cinch.

FIG. 5B is a partial perspective view of an intermediate configuration 50*b* of the assembly 50*a* of FIG. 5A with liner portion 54 partially extending through cinch 12. As shown in FIG. 5B, a pulling or pushing force may be applied to liner portion 54 in a direction P1 tending to cause liner portion 54 to partially advance through opening 14 and notch 16 of cinch 12.

Figure 5C:
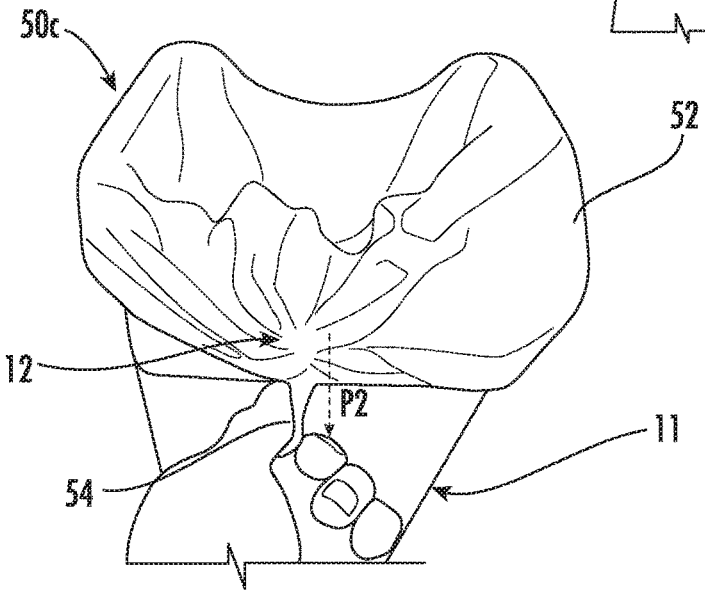
FIG. 5C is a partial perspective view of a final configuration of the assembly of FIG. 5A with the waste liner secured to the waste receptacle by the liner portion extending through the cinch.

FIG. 5C is a partial perspective view of a final configuration 50*c* of assembly 50*a* of FIG. 5A with waste liner 52 secured to waste receptacle 10 by liner portion 54 extending through cinch 12. As shown in FIG. 5C, the same or different pulling or pushing force as in FIG. 5B may be applied to liner portion 54 in a direction P2 tending to cause liner portion 54 to fully advance through opening 14 and notch 16 of cinch 12. In the configuration 50*c*, liner portion 54 is fully advanced through opening 14, and locked in notch 16. In particular, a portion of liner portion 54 may be pinched by notch 16 to cause waste liner 52 to be secured and retained to waste receptacle 10. In some embodiments, liner portion 54 may be further wrapped around, knotted, or extended into cinch 12, for example, about bottom edge 18 of cinch 12.

In embodiments in which waste receptacle 10 includes more than one cinch, respective liner portions of waste liner 52 adjacent respective cinches may be retained and secured to respective cinches.

Waste liner 52 may thus be secured to or retained on waste receptacle 10. When waste liner 52 is to be removed or replaced, a removing force may be applied in opposite directions as P1 and/or P2, or liner portion 54 may be cut off waste liner 52, or a combination thereof.

Thus, cinches according to the disclosure may be used to secure or retain waste liners on waste receptacles, and reduce or avoid inadvertent removal, collapse, or detachment of waste liners.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A waste receptacle, comprising:

a receptacle wall that defines an upper rim of the waste receptacle;

a removably attached cinch tab comprising one or more clips configured to secure the cinch tab to the upper rim; and a cinch defined by the removably attached cinch tab;

wherein the cinch comprises an opening configured to admit a liner portion of a waste liner, wherein the cinch comprises a notch continuous with and extending away from the opening, wherein at least a portion of the opening narrows in width in a direction extending between the notch and a lower end of the cinch, wherein the opening and the notch are configured to retain the liner portion to at least partially secure the waste liner to the waste receptacle, wherein the cinch tab is spaced from the receptacle wall by a spacing S adjacent a lower edge of the opening, wherein the spacing S is defined by the receptacle wall and the cinch tab, and wherein the spacing S is greater than a predetermined threshold spacing.

2. The waste receptacle of claim 1, wherein the cinch tab is angled at an interior angle β relative to the upper rim, wherein the interior angle β is greater than a predetermined threshold angle.

3. The waste receptacle of claim 1, wherein the cinch tab defines a substantially flat surface contour.

4. The waste receptacle of claim 1, wherein the cinch tab defines a curved surface contour.

5. The waste receptacle of claim 1, wherein the cinch tab extends continuously about the cinch.

6. The waste receptacle of claim 1, wherein the cinch tab defines a discontinuity opposing the notch and extending away from the opening of the cinch.

7. The waste receptacle of claim 1, wherein opposing edges of the notch define an interior angle a, wherein the interior angle a is less than a predetermined threshold angle.

8. The waste receptacle of claim 1, wherein a maximum spacing W1 of opposing edges of the opening of the cinch is greater than a maximum spacing of opposing edges of the notch W2 by a predetermined threshold.

9. The waste receptacle of claim 1, wherein the opening of the cinch is substantially circular, oval, oblate, or ellipsoidal.

10. The waste receptacle of claim 1, wherein the opening of the cinch defines a zig-zag periphery.

11. The waste receptacle of claim 1, wherein the notch of the cinch defines a zig-zag periphery.

12. The waste receptacle of claim 1, wherein the cinch is substantially symmetric about a symmetry axis.

13. The waste receptacle of claim 1, wherein the cinch is substantially asymmetric or skewed.

14. The waste receptacle of claim 1, wherein the waste receptacle comprises an upper rim adjacent to and continuous with the cinch tab, wherein the cinch tab is angled relative to the upper rim, and wherein the notch extends from the cinch tab to the upper rim.

15. The waste receptacle of claim 14, wherein the waste receptacle comprises a curved transition between the cinch tab and the upper rim.

16. The waste receptacle of claim 1, wherein the cinch has a teardrop-shaped periphery.

17. The waste receptacle of claim 1, wherein the waste receptacle comprises a housing configured to receive and retain the waste liner.

18. The waste receptacle of claim 17, wherein the housing comprises a metal, an alloy, a polymer, a glass, a fabric, a composite, or combinations thereof.

19. The waste receptacle of claim 18, wherein the housing is substantially rigid.

20. A waste receptacle, comprising:

a receptacle wall that defines an upper rim of the waste receptacle;

a removably attached cinch tab comprising one or more clips configured to secure the cinch tab to the upper rim; and a cinch defined by the removably attached cinch tab;

wherein the cinch comprises an opening configured to admit a liner portion of a waste liner, wherein the cinch comprises a notch continuous with an extending from the opening, wherein at least a portion of the opening narrows in width in a direction extending from the notch, wherein the opening and the notch are configured to retain the liner portion to at least partially secure the waster liner to the waste receptacle, wherein the opening is spaced from the receptacle wall by a spacing S, wherein the spacing S is defined by the receptacle wall and the cinch tab, and wherein the spacing S is greater than a predetermined threshold spacing.

* * * * *